US012553241B2

(12) United States Patent
Duque et al.

(10) Patent No.: US 12,553,241 B2
(45) Date of Patent: Feb. 17, 2026

(54) ROOFING SHINGLE SYSTEM AND STARTER ROOFING SHINGLES FOR USE THEREIN

(71) Applicant: BMIC LLC, Dallas, TX (US)

(72) Inventors: Luis Duque, Hackensack, NJ (US); Todd Weiner, Dumont, NJ (US); Nicholas Soto, Waxahachie, TX (US); Thomas Lowrey, Waxahachie, TX (US); Lyan Ortiz, Waxahachie, TX (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 19/220,584

(22) Filed: May 28, 2025

(65) Prior Publication Data

US 2025/0369227 A1 Dec. 4, 2025

Related U.S. Application Data

(60) Provisional application No. 63/652,353, filed on May 28, 2024.

(51) Int. Cl.
*E04D 1/30* (2006.01)
*E04D 1/34* (2006.01)

(52) U.S. Cl.
CPC ..... *E04D 1/30* (2013.01); *E04D 1/34* (2013.01); *E04D 2001/3435* (2013.01); *E04D 2001/3491* (2013.01)

(58) Field of Classification Search
CPC ..... E04D 1/30; E04D 2001/3435; E04D 1/34; E04D 2001/3491
See application file for complete search history.

(56) References Cited

U.S. PATENT DOCUMENTS

| | | | | |
|---|---|---|---|---|
| 1,450,182 | A | 4/1923 | Lamm et al. | |
| 1,902,155 | A | 3/1933 | Berkheimer | |
| 1,927,696 | A | 9/1933 | Applegate | |
| 2,271,728 | A | 2/1942 | Bainbridge | |
| 2,340,038 | A | 1/1944 | Buczkowski et al. | |
| 3,434,259 | A * | 3/1969 | Le Rae | E04D 1/29 52/420 |
| 4,185,436 | A | 1/1980 | Vallee | |
| 4,218,857 | A | 8/1980 | Vallee | |

(Continued)

FOREIGN PATENT DOCUMENTS

CA 2989649 A1 6/2019

*Primary Examiner* — Adriana Figueroa
(74) *Attorney, Agent, or Firm* — Venable LLP

(57) ABSTRACT

A roofing system includes a roofing substrate, a starter course of starter roofing shingles adhered to the roofing substrate, and a first course of roofing shingles vertically adjacent to the starter course. At least one starter roofing shingle of the starter course includes a first sealant line disposed on the front surface of the at least one starter roofing shingle that extends substantially across the length of the front surface of the at least one starter roofing shingle, and a second sealant line disposed on the back surface of the at least one starter roofing shingle that extends substantially across the length of the back surface of the at least one starter roofing shingle. The first sealant line is positioned opposite to the second sealant line at substantially the same distance along the width of the at least one starter roofing shingle.

14 Claims, 4 Drawing Sheets

(56) References Cited

U.S. PATENT DOCUMENTS 4,637,191 A 1/1987 Smith
4,824,880 A * 4/1989 Algrim ..... E04D 1/29 524/68
6,199,338 B1 * 3/2001 Hudson, Jr. ..... E04D 1/29 52/518
6,367,221 B1 4/2002 Elliott
6,378,259 B1 * 4/2002 Carlson ..... E04D 12/002 156/291
6,852,185 B2 * 2/2005 Sanger ..... E04D 1/29 52/745.21
6,874,289 B2 * 4/2005 Koch ..... E04D 1/30 52/522
6,936,329 B2 8/2005 Kiik et al.
7,204,063 B2 * 4/2007 Kandalgaonkar ..... E04D 1/2918 52/551
7,578,108 B2 * 8/2009 Swanson ..... E04D 1/34 52/553
8,968,507 B2 3/2015 Elliot et al.
9,540,817 B2 1/2017 Folkersen et al.
9,874,017 B2 1/2018 Jenkins et al.
10,370,853 B2 * 8/2019 Grubka ..... E04D 1/36
10,487,507 B2 11/2019 Kasprzak et al.
10,577,800 B2 3/2020 Folkersen et al.
10,808,406 B2 10/2020 Folkersen et al.
10,844,604 B2 11/2020 Folkersen et al.
11,959,281 B2 * 4/2024 Boss ..... E04D 1/26
12,276,105 B2 * 4/2025 Leitch ..... E04D 1/125
2006/0243388 A1 * 11/2006 Kubiak ..... B32B 25/16 156/289
2015/0089895 A1 * 4/2015 Leitch ..... E04D 1/26 52/518
2021/0214946 A1 * 7/2021 Selbach ..... E04D 5/12
2023/0110284 A1 4/2023 Boss et al.

* cited by examiner

ROOFING SHINGLE SYSTEM AND STARTER ROOFING SHINGLES FOR USE THEREIN

This application claims the priority of U.S. provisional application Ser. No. 63/652,353 entitled "Roofing Shingle System and Starter Roofing Shingles for Use Therein" filed May 28, 2024, which is incorporated herein by reference in its entirety for all purposes.

FIELD OF THE INVENTION

This invention relates to starter shingles and a roofing shingle system and kit that utilizes the starter shingles.

BACKGROUND OF THE INVENTION

During installation of shingles on a roof, an initial row of shingles, referred to as "starter shingles," are installed on a roofing substrate prior to the first course of finish shingles that comprise the visible portion of the roof. The starter shingles are typically nailed to the roofing substrate. There exists a need, however, to enable the starter shingles to be easily attached to a roofing substrate, while also preventing wind uplift.

SUMMARY OF THE INVENTION

One embodiment of this invention pertains to a roofing system comprising a roofing substrate and a starter course of starter roofing shingles adhered to the roofing substrate. The starter course comprising at least one starter roofing shingle having a front surface, a back surface, a top edge, a lower edge, a length, and a width, a first sealant line disposed on the front surface of the at least one starter roofing shingle that extends substantially across the length of the front surface of the at least one starter roofing shingle, and a second sealant line disposed on the back surface of the at least one starter roofing shingle that extends substantially across the length of the back surface of the at least one starter roofing shingle. The roofing system comprises a first course of roofing shingles vertically adjacent to the starter course, the first course comprising at least one first course roofing shingle. The first sealant line is positioned opposite to the second sealant line at substantially the same distance along the width of the at least one starter roofing shingle. The at least one starter roofing shingle is adhered to the roofing substrate with the second sealant line and is adhered to the at least one first course roofing shingle with the first sealant line.

In one embodiment, a third sealant line is disposed on the front surface of the at least one starter roofing shingle that extends substantially across the length of the front surface.

In one embodiment, a fourth sealant line is disposed on the back surface of the at least one starter roofing shingle that extends substantially across the length of the back surface, wherein the fourth sealant line is positioned opposite to the third sealant line at substantially the same distance along the width of the least one starter roofing shingle.

In one embodiment, the first sealant line and the second sealant line are located on a lower half of the at least one starter roofing shingle, and wherein the third sealant line and the fourth sealant line are located on an upper half of the at least one starter roofing shingle.

In one embodiment, the first sealant line comprises a first sealant line release layer configured to be removed prior to adhering the at least one first course roofing shingle on the at least one starter roofing shingle. In one embodiment, the second sealant line comprises a second sealant line release layer configured to be removed prior to adhering the at least one starter roofing shingle to the roofing substrate.

In one embodiment, the third sealant line comprises a third sealant line release layer configured to be removed prior to adhering the at least one first course roofing shingle on the at least one starter roofing shingle. In one embodiment, the fourth sealant line comprises a fourth sealant line release layer configured to be removed prior to adhering the at least one starter roofing shingle to the roofing substrate.

In one embodiment, the first sealant line and the third sealant line are the only sealant lines on the front surface of the at least one starter roofing shingle.

In one embodiment, the second sealant line and the fourth sealant line are the only sealant lines on the back surface of the at least one starter roofing shingle.

In one embodiment, the first sealant line, the second sealant line, or both, extend substantially across the length of the front surface of the at least one starter roofing shingle as a series of adjacent, equally spaced, dots or dashes of adhesive.

In one embodiment, the first sealant line, the second sealant line, or both, extend substantially across the length of the front surface of the at least one starter roofing shingle as a single continuous line of adhesive.

In one embodiment, the first sealant line, the second sealant line, or both, comprise a plurality of sealant lines.

In one embodiment, the first sealant line comprises a plurality of first sealant lines and the second sealant line comprises a plurality of second sealant lines, wherein each first sealant line of the plurality of first sealant lines is opposite a respective second sealant line of the plurality of second sealant lines at substantially the same distance along the width of the at least one starter roofing shingle.

In one embodiment, the first sealant line is a zone of sealant that has a greater width along the width of the at least one starter roofing shingle than the second sealant line.

In one embodiment, the first sealant line, the second sealant line, or both, comprise a self-sealing adhesive.

In one embodiment, the second sealant line disposed on the back surface of the at least one starter roofing shingle is adhered only to the roofing substrate.

In one embodiment, the first sealant line is the only sealant line on the front surface of the at least one starter roofing shingle.

In one embodiment, the second sealant line is the only sealant line on the back surface of the at least one starter roofing shingle.

In one embodiment, the at least one starter roofing shingle is a single layer shingle.

In one embodiment, the at least one starter roofing shingle comprises no dragon teeth.

In one embodiment, the at least one starter roofing shingle has no cuts, tabs, or openings.

In one embodiment, the first sealant line is positioned directly opposite to the second sealant line.

In one embodiment, the first sealant line, the second sealant line, or both, is covered with a release tape.

In one embodiment, the roofing substrate comprises a roof deck or an underlayment that is positioned on a roof deck.

Another embodiment of this invention pertains to a method comprising obtaining a plurality of starter roofing shingles, adhering the plurality of starter roofing shingles as a starter course on a roofing substrate, obtaining a plurality of first course roofing shingles, and adhering the plurality of first course roofing shingles to the starter roofing shingles in a vertically adjacent orientation. Each starter roofing shingle of the plurality of starter roofing shingles includes a front surface, a back surface, a top edge, a lower edge, a length, and a width, a first sealant line disposed on the front surface of the starter roofing shingle that extends substantially across the length of the front surface of the starter roofing shingle, and a second sealant line disposed on the back surface of the starter roofing shingle that extends substantially across the length of the back surface of the starter roofing shingle. The first sealant line is positioned opposite to the second sealant line at substantially the same distance along the width of the starter roofing shingle. The starter roofing shingle is adhered to the roofing substrate with the second sealant line and is adhered to the first course roofing shingle with the first sealant line.

In one embodiment, the method comprises adhering the second sealant line of each starter roofing shingle of the plurality of starter roofing shingles only to the roofing substrate.

In one embodiment, the method comprises adhering the first sealant line only to a roofing shingle of the plurality of first course roofing shingles.

In one embodiment, the first sealant line is disposed on the front surface of each starter roofing shingle is the only sealant line on the front surface of each starter roofing shingle of the plurality of starter roofing shingles.

In one embodiment, the method comprises providing a third sealant line on the front surface of the at least one starter roofing shingle that extends substantially across the length of the front surface.

In one embodiment, the method comprises providing a fourth sealant line on the back surface of the at least one starter roofing shingle that extends substantially across the length of the back surface, wherein the fourth sealant line is positioned opposite to the third sealant line at substantially the same distance along the width of the least one starter roofing shingle.

In one embodiment, the first sealant line and the second sealant line are located on a lower half of the at least one starter roofing shingle, and wherein the third sealant line and the fourth sealant line are located on an upper half of the at least one starter roofing shingle.

In one embodiment, the first sealant line comprises a first sealant line release layer configured to be removed prior to adhering the at least one first course roofing shingle on the at least one starter roofing shingle. In one embodiment, the second sealant line comprises a second sealant line release layer configured to be removed prior to adhering the at least one starter roofing shingle to the roofing substrate.

In one embodiment, the third sealant line comprises a third sealant line release layer configured to be removed prior to adhering the at least one first course roofing shingle on the at least one starter roofing shingle. In one embodiment, the fourth sealant line comprises a fourth sealant line release layer configured to be removed prior to adhering the at least one starter roofing shingle to the roofing substrate.

In one embodiment, the first sealant line and the third sealant line are the only sealant lines on the front surface of the at least one starter roofing shingle.

In one embodiment, the second sealant line and the fourth sealant line are the only sealant lines on the back surface of the at least one starter roofing shingle.

In one embodiment, the first sealant line, the second sealant line, or both, extend substantially across the length of the front surface of the at least one starter roofing shingle as a series of adjacent, equally spaced, dots or dashes of adhesive.

In one embodiment, the first sealant line, the second sealant line, or both, extend substantially across the length of the front surface of the at least one starter roofing shingle as a single continuous line of adhesive.

In one embodiment, the first sealant line, the second sealant line, or both, comprise a plurality of sealant lines.

In one embodiment, the first sealant line comprises a plurality of first sealant lines and the second sealant line comprises a plurality of second sealant lines, wherein each first sealant line of the plurality of first sealant lines is opposite a respective second sealant line of the plurality of second sealant lines at substantially the same distance along the width of the at least one starter roofing shingle.

In one embodiment, the first sealant line is a zone of sealant that has a greater width along the width of the at least one starter roofing shingle than the second sealant line.

In one embodiment, the first sealant line, the second sealant line, or both, comprise a self-sealing adhesive.

In one embodiment, the second sealant line disposed on the back surface of the at least one starter roofing shingle is adhered only to the roofing substrate.

In one embodiment, the first sealant line is the only sealant line on the front surface of the at least one starter roofing shingle.

In one embodiment, the second sealant line is the only sealant line on the back surface of the at least one starter roofing shingle.

In one embodiment, the at least one starter roofing shingle is a single layer shingle.

In one embodiment, the at least one starter roofing shingle comprises no dragon teeth.

In one embodiment, the at least one starter roofing shingle has no cuts, tabs, or openings.

In one embodiment, the first sealant line is positioned directly opposite to the second sealant line.

In one embodiment, the first sealant line, the second sealant line, or both, is covered with a release tape.

In one embodiment, the roofing substrate comprises a roof deck or an underlayment that is positioned on a roof deck.

Yet another embodiment of this invention pertains to a kit comprising a plurality of starter roofing shingles configured to adhere to a roofing substrate, at least one starter roofing shingle of the plurality of starter roofing shingles having a front surface, a back surface, a top edge, a lower edge, a length, and a width, a first sealant line disposed on the front surface of the at least one starter roofing shingle that extends substantially across the length of the front surface of the at least one starter roofing shingle, and a second sealant line disposed on the back surface of the at least one starter roofing shingle that extends substantially across the length of the back surface of the at least one starter roofing shingle; and a plurality of first course roofing shingles configured to adhere to the plurality of starter roofing shingles. The first sealant line is positioned opposite to the second sealant line at substantially the same distance along the width of the at least one starter roofing shingle. The at least one starter roofing shingle is configured to adhere to the roofing substrate with the second sealant line and is configured to adhere to at least one first course roofing shingle with the first sealant line.

In one embodiment, the kit comprises instructions for installing the plurality of starter roofing shingles and the plurality of first course roofing shingles.

In one embodiment, a third sealant line is disposed on the front surface of the at least one starter roofing shingle that extends substantially across the length of the front surface.

In one embodiment, a fourth sealant line is disposed on the back surface of the at least one starter roofing shingle that extends substantially across the length of the back surface, wherein the fourth sealant line is positioned opposite to the third sealant line at substantially the same distance along the width of the least one starter roofing shingle.

In one embodiment, the first sealant line and the second sealant line are located on a lower half of the at least one starter roofing shingle, and wherein the third sealant line and the fourth sealant line are located on an upper half of the at least one starter roofing shingle.

In one embodiment, the first sealant line comprises a first sealant line release layer configured to be removed prior to adhering the at least one first course roofing shingle on the at least one starter roofing shingle. In one embodiment, the second sealant line comprises a second sealant line release layer configured to be removed prior to adhering the at least one starter roofing shingle to the roofing substrate.

In one embodiment, the third sealant line comprises a third sealant line release layer configured to be removed prior to adhering the at least one first course roofing shingle on the at least one starter roofing shingle. In one embodiment, the fourth sealant line comprises a fourth sealant line release layer configured to be removed prior to adhering the at least one starter roofing shingle to the roofing substrate.

In one embodiment, the first sealant line and the third sealant line are the only sealant lines on the front surface of the at least one starter roofing shingle.

In one embodiment, the second sealant line and the fourth sealant line are the only sealant lines on the back surface of the at least one starter roofing shingle.

In one embodiment, the first sealant line, the second sealant line, or both, extend substantially across the length of the front surface of the at least one starter roofing shingle as a series of adjacent, equally spaced, dots or dashes of adhesive.

In one embodiment, the first sealant line, the second sealant line, or both, extend substantially across the length of the front surface of the at least one starter roofing shingle as a single continuous line of adhesive.

In one embodiment, the first sealant line, the second sealant line, or both, comprise a plurality of sealant lines.

In one embodiment, the first sealant line comprises a plurality of first sealant lines and the second sealant line comprises a plurality of second sealant lines, wherein each first sealant line of the plurality of first sealant lines is opposite a respective second sealant line of the plurality of second sealant lines at substantially the same distance along the width of the at least one starter roofing shingle.

In one embodiment, the first sealant line is a zone of sealant that has a greater width along the width of the at least one starter roofing shingle than the second sealant line.

In one embodiment, the first sealant line, the second sealant line, or both, comprise a self-sealing adhesive.

In one embodiment, the second sealant line disposed on the back surface of the at least one starter roofing shingle is adhered only to the roofing substrate.

In one embodiment, the first sealant line is the only sealant line on the front surface of the at least one starter roofing shingle.

In one embodiment, the second sealant line is the only sealant line on the back surface of the at least one starter roofing shingle.

In one embodiment, the at least one starter roofing shingle is a single layer shingle.

In one embodiment, the at least one starter roofing shingle comprises no dragon teeth.

In one embodiment, the at least one starter roofing shingle has no cuts, tabs, or openings.

In one embodiment, the first sealant line is positioned directly opposite to the second sealant line.

In one embodiment, the first sealant line, the second sealant line, or both, is covered with a release tape.

BRIEF DESCRIPTION OF THE FIGURES

Features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION OF THE INVENTION

Figure 1:
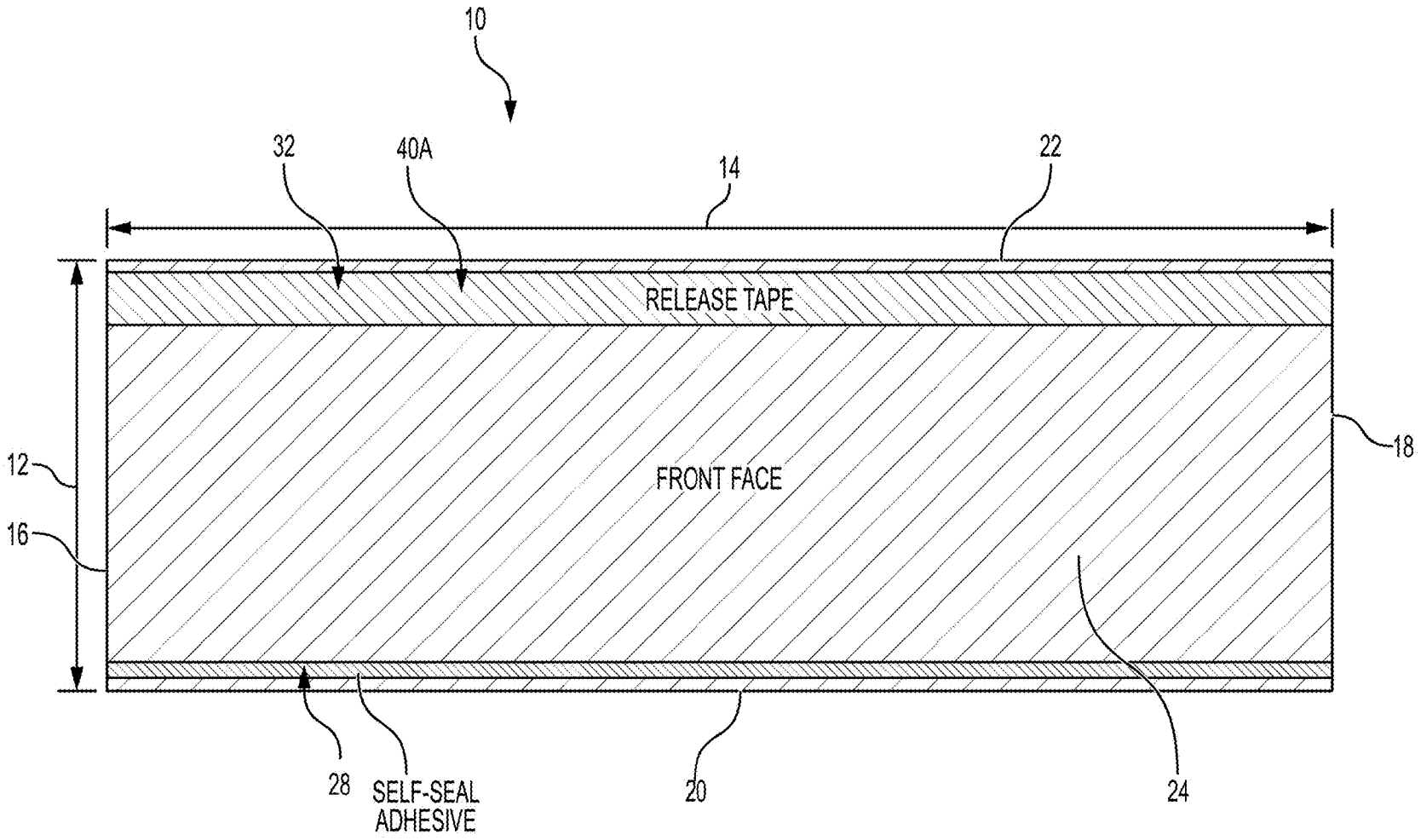
FIG. 1 illustrates a schematic front view of a starter roofing shingle, according to an embodiment of the invention.

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the meaning of "a," "an," and "the" include plural references. The meaning of "in" includes "in" and "on."

As used herein, terms such as "comprising" "including," and "having" do not limit the scope of a specific claim to the materials or steps recited by the claim.

As used herein, terms such as "consisting of" limit the scope of a specific claim to the materials and steps recited by the claim.

As discussed, during installation of shingles on a roof, an initial row of shingles, referred to as "starter shingles," are installed on a roofing substrate prior to the first course of finish shingles that comprise the visible portion of the roof. The starter shingles are typically nailed to the roofing substrate.

This invention, in embodiments, relates to a starter shingle for improving the wind uplift resistance of a starter strip of roofing shingles. The starter shingle of the present disclosure has two strips of sealant, one on the front face of the starter shingle and one on the back face of the starter shingle. The starter single of the present disclosure provides a secondary sealant strip on the back face of the starter shingle to reduce the probability of blow offs or wind uplift. The sealant strip on the front face seals the starter shingle to the first course of shingles.

One embodiment of this invention pertains to a roofing system comprising a roofing substrate and a starter course of starter roofing shingles adhered to the roofing substrate. The starter course comprising at least one starter roofing shingle having a front surface, a back surface, a top edge, a lower edge, a length, and a width, a first sealant line disposed on the front surface of the at least one starter roofing shingle that extends substantially across the length of the front surface of the at least one starter roofing shingle, and a second sealant line disposed on the back surface of the at least one starter roofing shingle that extends substantially across the length of the back surface of the at least one starter roofing shingle. The roofing system comprises a first course of roofing shingles vertically adjacent to the starter course, the first course comprising at least one first course roofing shingle. The first sealant line is positioned opposite to the second sealant line at substantially the same distance along the width of the at least one starter roofing shingle. The at least one starter roofing shingle is adhered to the roofing substrate with the second sealant line and is adhered to the at least one first course roofing shingle with the first sealant line.

Figure 2:
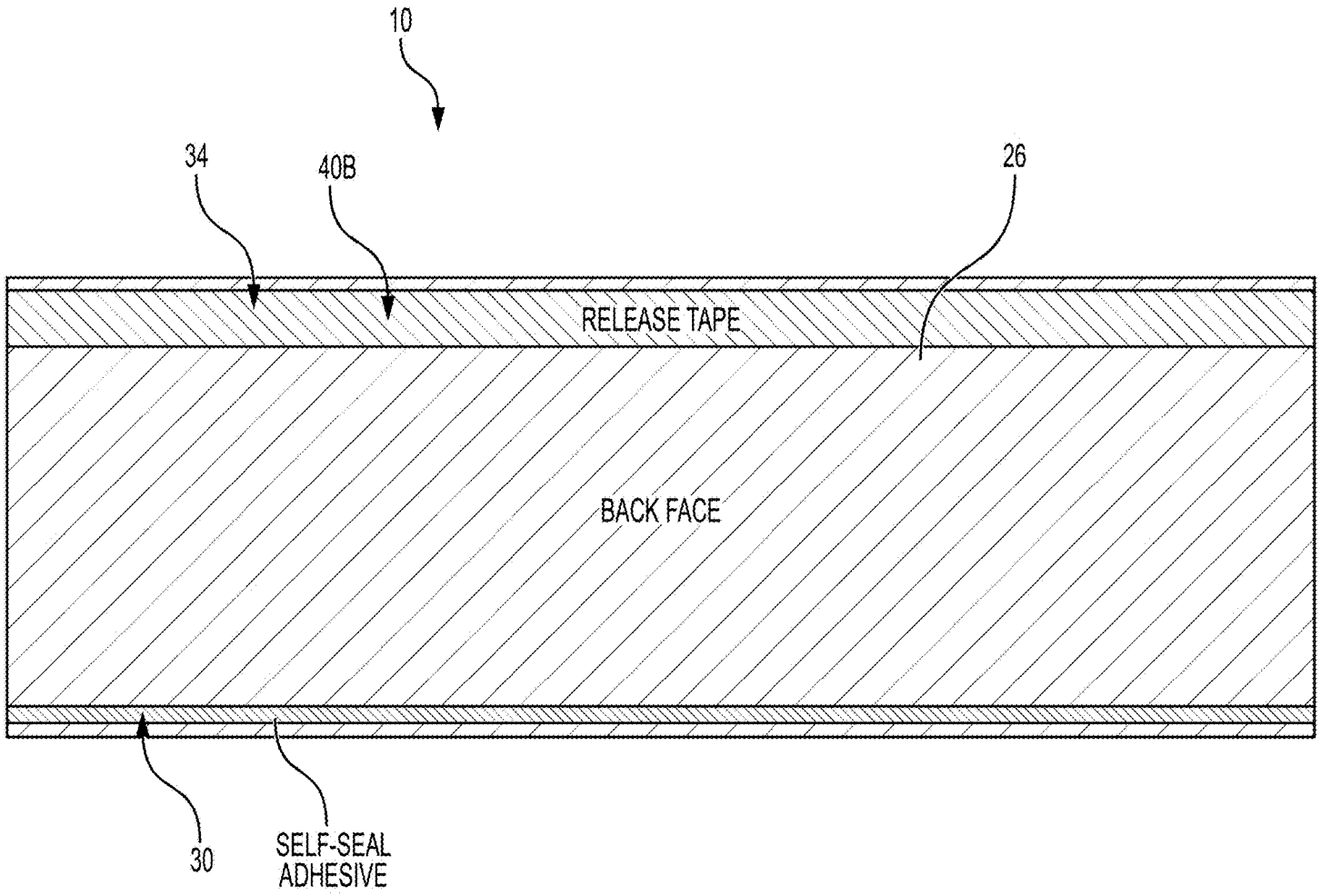
FIG. 2 illustrates a schematic back view of a starter roofing shingle, according to an embodiment of the invention.

Referring now to the figures, FIGS. 1 and 2 illustrate an exemplary starter roofing shingle 10, according to the present disclosure. FIG. 1 illustrates a front plan view of the starter roofing shingle 10 and FIG. 2 illustrates a back plan view of the starter roofing shingle 10. The starter roofing shingle 10 has a width 12 and a length 14. The starter roofing shingle 10 further includes a first side edge 16, a second side edge 18, a lower (or bottom) edge 20, a top edge 22, a front surface 24, and a back surface 26. The width 12 is defined between the lower edge 20 and the top edge 22. The length 14 is defined between the first side edge 16 and the second side edge 18.

As further illustrated in FIGS. 1 and 2, the starter roofing shingle 10 has a first sealant line 28, a second sealant line 30, a third sealant line 32, and a fourth sealant line 34. The first sealant line 28 and the third sealant line 32 are located on the front surface 24 of the starter roofing shingle 10, and the second sealant line 30 and the fourth sealant line 34 are located on the back surface 26 of the starter roofing shingle 10. As shown in FIGS. 1 and 2, a release layer (or tape) 40A, 40B is positioned over the third sealant line 32 and/or the fourth sealant line 34. The release layer may be a thin film covering the respective sealant line. The release layer 40A, 40B covers the sealant line and is configured to be removed prior to use of the starter shingle 10. The release layer is optional. In some embodiments, although not illustrated, the release layer may be included with the first sealant line 28 or the second sealant line 30 or both. In some embodiments, the release layer may be included with the third sealant line 32 or the fourth sealant line 34 or both. In some embodiments, the first sealant line 28, the second sealant line 30, or both, comprise a self-sealing adhesive.

In some embodiments, the first sealant line 28 is the only sealant line on the front surface 24 of the starter roofing shingle 10, such that the third sealant line 32 is omitted. In one embodiment, the second sealant line 30 is the only sealant line on the back surface 26 of the starter roofing shingle 10, such that the fourth sealant line 34 is omitted. In some embodiments, the first sealant line 28 and the third sealant line 32 are the only sealant lines on the front surface 24 and the second sealant line 30 and the fourth sealant line 34 are the only sealant lines on the back surface 26.

In the starter roofing shingle 10 of the embodiment of FIGS. 1 and 2, the first sealant line 28 and the second sealant line 30 are directly opposite one another such that the first sealant line 28 and the second sealant line 30 are substantially at the same distance along the width 12. Likewise, the third sealant line 32 and the fourth sealant line 34 are directly opposite one another such that the third sealant line 32 and the fourth sealant line 34 are substantially at the same distance along the width 12. As illustrated in FIGS. 1 and 2, the first sealant line 28 and the second sealant line 30 are located on the bottom half of the starter roofing shingle 10 near the lower edge 20, while the third sealant line 32 and the fourth sealant line 34 are located on the upper half of the starter roofing shingle 10 near the top edge 22.

Figure 3:
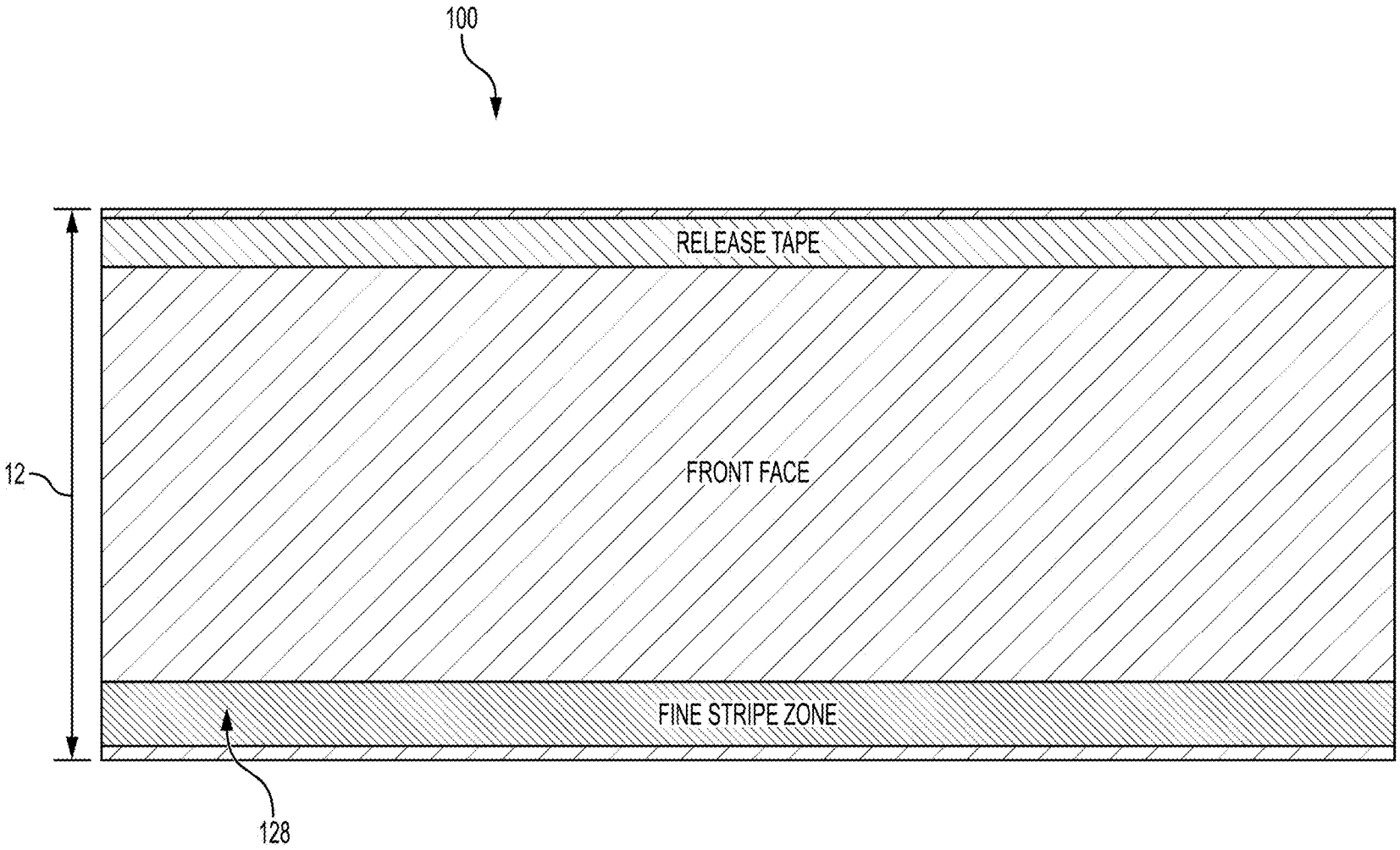
FIG. 3 illustrates a schematic front view of a starter roofing shingle, according to an embodiment of the invention.

FIG. 3 illustrates another exemplary starter roofing shingle 100. The starter roofing shingle 100 is substantially similar to the starter roofing shingle 10, except for the first sealant line 128, as described to follow. Accordingly, the same reference numerals will be used for components of the starter roofing shingle 100 that are the same as or similar to the components of the starter roofing shingle 10 discussed above. Similarly, some part numbers are omitted, however, like illustrated parts are understood to be the same as or similar to the parts illustrated in FIGS. 1 and 2 with respect to the starter roofing shingle 10. The description of these components above also applies to this embodiment, and a detailed description of these components is omitted here. The alternatives, modifications, and additional examples described above with respect to the starter roofing shingle 10 apply equally to the starter roofing shingle 100 and are, thus, not repeated herein for clarity of the description.

In the embodiment of FIG. 3, the starter roofing shingle 100 includes a first sealant line 128. The first sealant line 128 is a fine stripe zone of adhesive. That is, the first sealant line 128 extends more along the width 12 (or has a greater width) as compared to the first sealant line 28 of the starter roofing shingle 10 of FIG. 1. Thus, the first sealant line 128 provides a larger surface area for sealing as compared to the first sealant line 28. In the embodiment of FIG. 3, the first sealant line 128 is applied to the face of the starter roofing shingle 100 that is in contact with the roof deck (e.g., the back surface as in FIG. 2), but the face of the starter roofing shingle 100 that is in contact with the next course of shingles (e.g., the front surface) includes a fine stripe of adhesive in an area in which an adhesive (e.g., a self-seal adhesive) of a shingle of the next course of shingles will be in contact with this area. According to one embodiment, the first sealant line 128 is a self-seal adhesive.

According to one embodiment, the starter roofing shingle 10 and the starter roofing shingle 100 are starter singles that provide a base under roofing shingles at the eaves of the roofing substrate. According to another embodiment, the starter roofing shingles 10, 100 are solid, single layer shingles with no cuts, tabs, openings or dragon teeth therein. That is, as illustrated in FIGS. 1 to 3, the perimeter or edges of the starter shingles 10, 100 are continuous, solid lines along the width 12 and the length 14. In contrast, the roofing shingles applied on top of the starter shingle course and in subsequent vertically adjacent courses may have cuts, tabs, openings, or dragon teeth, such as shown in FIG. 4.

According to an embodiment, in the starter roofing shingles 10, 100, the first sealant line 28, 128 and the second sealant line 30 may be self-seal adhesives.

Figure 4:
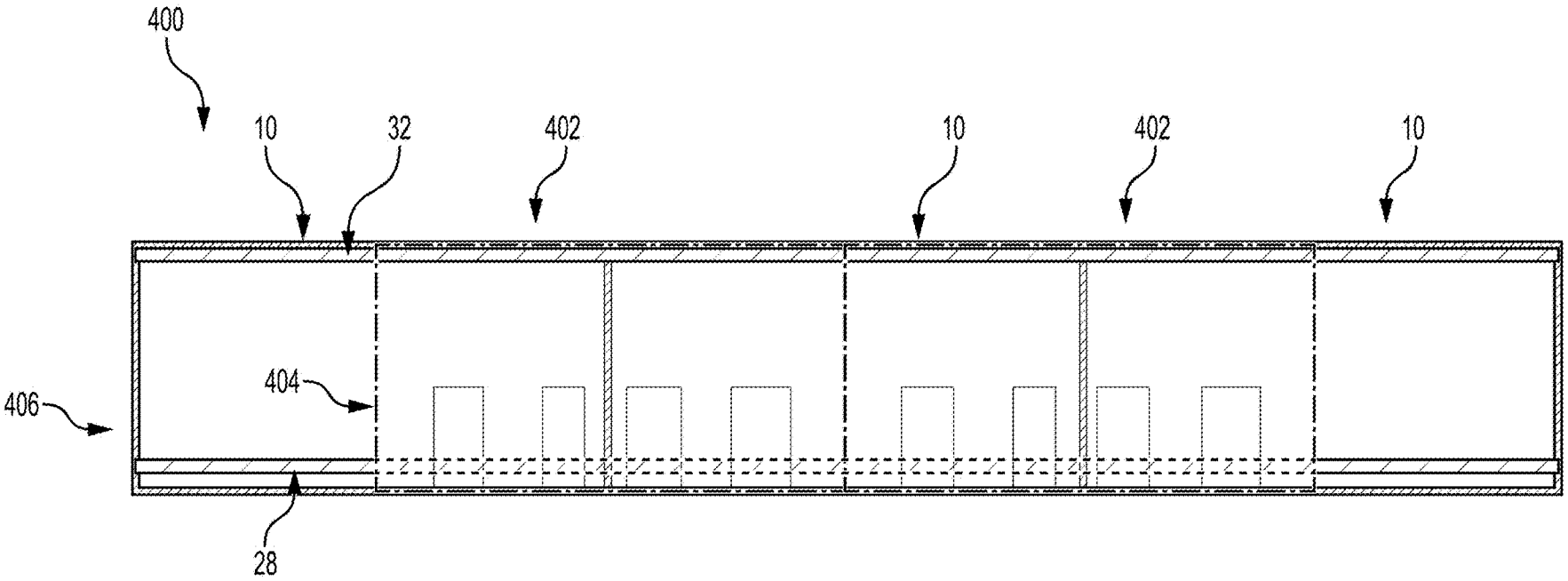
FIG. 4 illustrates a schematic front view of a roofing system having a starter shingle, according to an embodiment of the invention.

As shown in the embodiment of FIG. 4, a roofing system 400 comprises a plurality of starter roofing shingles 10 and a plurality of roofing shingles 402. The plurality of roofing shingles 402 are illustrated transparent to facilitate understanding only. When roofing shingles are installed on a roofing substrate (not shown) in a series of overlapping courses, a first course 404 of roofing shingles 402 is installed along an edge or eave of the roofing substrate. Before installing the first course 404 of roofing shingles 402, a starter course 406 of starter roofing shingles 10 is installed along an edge or eave of the roofing substrate. A second sealant line (see, e.g., second sealant line 30 of FIG. 2) provides adhesion between the back surface 26 of the starter roofing shingle 10 and the upper surface of the roofing substrate. The first sealant line 28 provides adhesion between the front surface 24 of the starter roofing shingle 10 of the starter course 406 and a back surface (not visible) of a roofing shingle 402 of the first course 404 of roofing shingles 402. Optionally, the third sealant line 32 provides adhesion between the front surface 24 of the starter roofing shingle 10 and the back surface of the roofing shingle 402. As further shown in FIG. 4, the first course 404 completely overlaps the starter course 406. A second course (not shown) of the roofing shingles 402 may be installed in a vertically adjacent course to the first course 404 such that there is overlap of the roofing shingles 402, with a lower portion of the roofing shingles 402 of the first course 404 exposed.

Another embodiment of this invention pertains to a method comprising obtaining a plurality of starter roofing shingles, adhering the plurality of starter roofing shingles as a starter course on a roofing substrate, obtaining a plurality of first course roofing shingles, and adhering the plurality of first course roofing shingles to the starter roofing shingles in a vertically adjacent orientation. Each starter roofing shingle of the plurality of starter roofing shingles includes a front surface, a back surface, a top edge, a lower edge, a length, and a width, a first sealant line disposed on the front surface of the starter roofing shingle that extends substantially across the length of the front surface of the starter roofing shingle, and a second sealant line disposed on the back surface of the starter roofing shingle that extends substantially across the length of the back surface of the starter roofing shingle. The first sealant line is positioned opposite to the second sealant line at substantially the same distance along the width of the starter roofing shingle. The starter roofing shingle is adhered to the roofing substrate with the second sealant line and is adhered to the first course roofing shingle with the first sealant line.

Yet another embodiment of this invention pertains to a kit comprising a plurality of starter roofing shingles configured to adhere to a roofing substrate, at least one starter roofing shingle of the plurality of starter roofing shingles having a front surface, a back surface, a top edge, a lower edge, a length, and a width, a first sealant line disposed on the front surface of the at least one starter roofing shingle that extends substantially across the length of the front surface of the at least one starter roofing shingle, and a second sealant line disposed on the back surface of the at least one starter roofing shingle that extends substantially across the length of the back surface of the at least one starter roofing shingle; and a plurality of first course roofing shingles configured to adhere to the plurality of starter roofing shingles. The first sealant line is positioned opposite to the second sealant line at substantially the same distance along the width of the at least one starter roofing shingle. The at least one starter roofing shingle is configured to adhere to the roofing substrate with the second sealant line and is configured to adhere to at least one first course roofing shingle with the first sealant line.

In an embodiment, the roofing substrate comprises a roof deck, roof underlayment, roofing membrane, or combinations thereof.

In an embodiment, one or more, or all, of the sealant lines is formed of an adhesive.

In an embodiment, one or more, or all, of the sealant lines is formed of a continuous line along the length of the starter shingle.

In an embodiment, one or more, or all, of the sealant lines is formed of a series of dots or dashes of adhesive with symmetric separation therebetween along the length of the starter shingle.

In an embodiment, a third sealant line is disposed on the front surface of the at least one starter roofing shingle and extends substantially across the length of the front surface.

In an embodiment, a fourth sealant line is disposed on the back surface of the at least one starter roofing shingle and extends substantially across the length of the back surface, wherein the fourth sealant line is positioned opposite to the third sealant line at substantially the same distance along the width of the least one starter roofing shingle.

In an embodiment, the first sealant line and the second sealant line are located on a lower half of the at least one starter roofing shingle, and wherein the third sealant line and the fourth sealant line are located on an upper half of the at least one starter roofing shingle.

In one embodiment, the first sealant line comprises a first sealant line release layer configured to be removed prior to adhering the at least one first course roofing shingle on the at least one starter roofing shingle. In one embodiment, the second sealant line comprises a second sealant line release layer configured to be removed prior to adhering the at least one starter roofing shingle to the roofing substrate.

In an embodiment, the third sealant line comprises a third sealant line release layer configured to be removed prior to adhering the at least one first course roofing shingle on the at least one starter roofing shingle. In one embodiment, the fourth sealant line comprises a fourth sealant line release layer configured to be removed prior to adhering the at least one starter roofing shingle to the roofing substrate.

In an embodiment, the first sealant line and the third sealant line are the only sealant lines on the front surface of the at least one starter roofing shingle.

In an embodiment, the second sealant line and the fourth sealant line are the only sealant lines on the back surface of the at least one starter roofing shingle.

In an embodiment, the first sealant line, the second sealant line, or both, extend substantially across the length of the front surface of the at least one starter roofing shingle as a series of adjacent, equally spaced, dots or dashes of adhesive.

In an embodiment, the first sealant line, the second sealant line, or both, extend substantially across the length of the front surface of the at least one starter roofing shingle as a single continuous line of adhesive.

In an embodiment, the first sealant line, the second sealant line, or both, comprise a plurality of sealant lines.

In an embodiment, the first sealant line comprises a plurality of first sealant lines and the second sealant line comprises a plurality of second sealant lines, wherein each first sealant line of the plurality of first sealant lines is opposite a respective second sealant line of the plurality of second sealant lines at substantially the same distance along the width of the at least one starter roofing shingle.

In an embodiment, the first sealant line is a zone of sealant that has a greater width along the width of the at least one starter roofing shingle than the second sealant line.

In an embodiment, the first sealant line, the second sealant line, or both, comprise a self-sealing adhesive.

In an embodiment, the second sealant line disposed on the back surface of the at least one starter roofing shingle is adhered only to the roofing substrate.

In an embodiment, the first sealant line is the only sealant line on the front surface of the at least one starter roofing shingle.

In an embodiment, the second sealant line is the only sealant line on the back surface of the at least one starter roofing shingle.

In an embodiment, the at least one starter roofing shingle is a single layer shingle.

In an embodiment, the at least one starter roofing shingle comprises no dragon teeth.

In an embodiment, the at least one starter roofing shingle has no cuts, tabs, or openings.

In an embodiment, the first sealant line is positioned directly opposite to the second sealant line.

In an embodiment, the first sealant line, the second sealant line, or both, is covered with a release tape.

In an embodiment, the roofing substrate comprises a roof deck or an underlayment that is positioned on a roof deck.

In an embodiment, the method comprises adhering the second sealant line of each starter roofing shingle of the plurality of starter roofing shingles only to the roofing substrate.

In an embodiment, the method comprises adhering the first sealant line only to a roofing shingle of the plurality of first course roofing shingles.

In an embodiment, the first sealant line is disposed on the front surface of each starter roofing shingle is the only sealant line on the front surface of each starter roofing shingle of the plurality of starter roofing shingles.

In an embodiment, the method comprises providing a third sealant line on the front surface of the at least one starter roofing shingle that extends substantially across the length of the front surface.

In an embodiment, the method comprises providing a fourth sealant line on the back surface of the at least one starter roofing shingle that extends substantially across the length of the back surface, wherein the fourth sealant line is positioned opposite to the third sealant line at substantially the same distance along the width of the least one starter roofing shingle.

In an embodiment, the kit comprises instructions for installing the plurality of starter roofing shingles and the plurality of first course roofing shingles.

Accordingly, the starter shingle of the present disclosure provides for the addition of a secondary sealant strip on the back surface of the shingle, which results in an improvement in wind uplift performance, reduction of blow off concerns, and improvement of performance under wind forces and wind driven rain.

Accordingly, the starter shingle of the present disclosure provides a starter shingle with a sealant strip (e.g., an asphaltic sealant strip) on the bottom, roof-deck-facing side of the shingle. The sealant will bond to the underlying roofing substrate and reduce the risk of wind uplifting the shingle, which may cause a failure in the roofing system.

According to one embodiment, the starter strip shingle with adhesive on both faces will reinforce and improve the performance of the eave and ridge edge where the product is installed as part of the roofing protection system.

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

The invention claimed is:

1. A roofing system comprising:

a roofing substrate;

a starter course of starter roofing shingles adhered to the roofing substrate, wherein the starter course comprises at least one starter roofing shingle having a front surface, a back surface, a top edge, a lower edge, a length, and a width;

a first sealant line disposed on the front surface of the at least one starter roofing shingle that extends substantially across the length of the front surface of the at least one starter roofing shingle;

a second sealant line disposed on the back surface of the at least one starter roofing shingle that extends substantially across the length of the back surface of the at least one starter roofing shingle;

a third sealant line disposed on the front surface of the at least one starter roofing shingle that extends substantially across the length of the front surface; and a fourth sealant line disposed on the back surface of the at least one starter roofing shingle that extends substantially across the length of the back surface; and a first course of roofing shingles vertically adjacent to the starter course, the first course comprising at least one first course roofing shingle, wherein the first sealant line is positioned opposite to the second sealant line at substantially the same distance along the width of the at least one starter roofing shingle, wherein the fourth sealant line is positioned opposite to the third sealant line at substantially the same distance along the width of the least one starter roofing shingle, and wherein the at least one starter roofing shingle is adhered to the roofing substrate with the second sealant line and is adhered to the at least one first course roofing shingle with the first sealant line.

2. The roofing system according to claim 1, wherein the first sealant line and the second sealant line are located on a lower half of the at least one starter roofing shingle, and wherein the third sealant line and the fourth sealant line are located on an upper half of the at least one starter roofing shingle.

3. The roofing system according to claim 1, wherein at least one of the first sealant line or the second sealant line comprises a sealant line release layer configured to be removed prior to adhering the at least one starter roofing shingle to the roofing substrate.

4. The roofing system according to claim 1, wherein at least one of the third sealant line or the fourth sealant line comprises a sealant line release layer configured to be removed prior to adhering the at least one starter roofing shingle to the roofing substrate.

5. The roofing system according to claim 1, wherein the first sealant line and the third sealant line are the only sealant lines on the front surface of the at least one starter roofing shingle.

6. The roofing system according to claim 1, wherein the second sealant line and the fourth sealant line are the only sealant lines on the back surface of the at least one starter roofing shingle.

7. The roofing system according to claim 1, wherein at least one of the first sealant line or the second sealant line comprises a self-sealing adhesive.

8. The roofing system according to claim 1, wherein the at least one starter roofing shingle has no cuts, tabs, or openings.

9. A method comprising:

obtaining a plurality of starter roofing shingles;

adhering the plurality of starter roofing shingles as a starter course on a roofing substrate;

obtaining a plurality of first course roofing shingles; and adhering the plurality of first course roofing shingles to the plurality of starter roofing shingles in a vertically adjacent orientation, wherein each starter roofing shingle of the plurality of starter roofing shingles includes a front surface, a back surface, a top edge, a lower edge, a length, and a width;

a first sealant line disposed on the front surface of the starter roofing shingle that extends substantially across the length of the front surface of the starter roofing shingle;

a second sealant line disposed on the back surface of the starter roofing shingle that extends substantially across the length of the back surface of the starter roofing shingle;

a third sealant line disposed on the front surface of the starter roofing shingle that extends substantially across the length of the front surface of the starter roofing shingle; and a fourth sealant line disposed on the back surface of the starter roofing shingle that extends substantially across the length of the back surface of the starter roofing shingle, wherein the first sealant line is positioned opposite to the second sealant line at substantially the same distance along the width of the starter roofing shingle, wherein the fourth sealant line is positioned opposite to the third sealant line at substantially the same distance along the width of the starter roofing shingle, and wherein the starter roofing shingle is adhered to the roofing substrate with the second sealant line and is adhered to the first course roofing shingle with the first sealant line.

10. The method according to claim 9, further comprising adhering the second sealant line of each starter roofing shingle of the plurality of starter roofing shingles only to the roofing substrate.

11. The method according to claim 9, further comprising adhering the first sealant line only to a roofing shingle of the plurality of first course roofing shingles.

12. The method according to claim 9, wherein at least one of the first sealant line or the second sealant line comprises a sealant line release layer configured to be removed prior to adhering the plurality of starter roofing shingles to the roofing substrate.

13. A kit comprising:

a plurality of starter roofing shingles configured to adhere to a roofing substrate, at least one starter roofing shingle of the plurality of starter roofing shingles having a front surface, a back surface, a top edge, a lower edge, a length, and a width;

a first sealant line disposed on the front surface of the at least one starter roofing shingle that extends substantially across the length of the front surface of the at least one starter roofing shingle;

a second sealant line disposed on the back surface of the at least one starter roofing shingle that extends substantially across the length of the back surface of the at least one starter roofing shingle;

a third sealant line disposed on the front surface of the at least one starter roofing shingle that extends substantially across the length of the front surface of the at least one starter roofing shingle; and a fourth sealant line disposed on the back surface of the at least one starter roofing shingle that extends substantially across the length of the back surface of the at least one starter roofing shingle; and a plurality of first course roofing shingles configured to adhere to the plurality of starter roofing shingles, wherein the first sealant line is positioned opposite to the second sealant line at substantially the same distance along the width of the at least one starter roofing shingle, wherein the fourth sealant line is positioned opposite to the third sealant line at substantially the same distance along the width of the least one starter roofing shingle, and wherein the at least one starter roofing shingle is configured to adhere to the roofing substrate with the second sealant line and is configured to adhere to at least one first course roofing shingle of the plurality of first course roofing shingles with the first sealant line.

14. The kit according to claim 13, further comprising instructions for installing the plurality of starter roofing shingles and the plurality of first course roofing shingles.

* * * * *